US005986403A

United States Patent [19]

Jansen et al.

[11] Patent Number: 5,986,403

[45] Date of Patent: Nov. 16, 1999

[54] METHOD FOR MAKING A CAPPED ELECTRIC LAMP BY USING REDUCED INTERNAL PRESSURE TO COLLAPSE GLASS

[75] Inventors: Henricus P. J. Jansen, Kerkrade, Netherlands; Ulrich J. Morschel, Langerwehe, Germany

[73] Assignee: U.S. Philips Corporation, New York, N.Y.

[21] Appl. No.: 09/019,646

[22] Filed: Feb. 6, 1998

Related U.S. Application Data

[63] Continuation of application No. 08/634,595, Apr. 24, 1996, abandoned.

[30] Foreign Application Priority Data

Apr. 27, 1995 [EP] European Pat. Off. ..... 095201107

[51] Int. Cl.[6] ..... H01J 5/46; H01J 9/32

[52] U.S. Cl. ..... 313/623; 313/624; 313/634; 445/26; 445/43

[58] Field of Search ..... 445/26, 43; 313/623, 313/624, 634

[56] References Cited

U.S. PATENT DOCUMENTS 3,868,528 2/1975 Lake et al. ..... 313/623

*Primary Examiner*—Nimeshkumar D. Patel
*Assistant Examiner*—Joseph Williams
*Attorney, Agent, or Firm*—F. Brice Faller

[57] ABSTRACT

A quartz glass vessel having mutually opposed first and second neck-shaped portions is heated over the first neck-shaped portion while flushing the vessel with gas, then pinched over an external current wire and collapsed over a metal foil by means of reduced pressure to form a seal. The second neck-shaped portion may also be collapsed over a metal foil by reduced pressure in the lamp vessel to form a seal. The seals are preferably shaped to form flat external surfaces.

7 Claims, 2 Drawing Sheets

METHOD FOR MAKING A CAPPED ELECTRIC LAMP BY USING REDUCED INTERNAL PRESSURE TO COLLAPSE GLASS

CROSS REFERENCE TO RELATED APPLICATIONS

This is a continuation of U.S. Ser. No. 08/634,595 filed Apr. 24, 1996, now abandoned, which application is incorporated herein by reference.

BACKGROUND OF THE INVENTION

The invention relates to a capped electric lamp comprising:

a quartz glass vessel which is closed in a vacuumtight manner and which has a first and a second neck-shaped portion with respective seals in mutual opposition, through which seals respective current supply conductors extend to an electric element arranged in the lamp vessel, the latter having a filling;

a lamp cap connected to the lamp vessel, which current supply conductors each comprise a metal foil which is embedded in a respective seal in a vacuumtight manner and to which a respective internal current wire connected to the electric element is connected at a first end portion and a respective external current wire issuing from the relevant seal to the exterior is connected at a second end portion.

Such a capped electric lamp is known from U.S. Pat. No. 5,320,562. The lamp may be used as a vehicle headlamp, especially if the electric element is a pair of electrodes in an ionizable filling, but it may alternatively be used for other applications, for example optical applications. The lamp has the advantage of a comparatively long life and a high light output at a comparatively low power rating of approximately 35 W. The light is generated between electrodes which are spaced apart no more than a few millimeters, for example 4.5 mm, so that the lamp has a very high luminance and the generated light can be very well concentrated into a beam by a reflector and possibly a lens. The lamp vessel has comparatively small internal dimensions of, for example, approximately 1 to 3 mm diameter in the centre between the electrodes and approximately 4.5 to 9 mm length.

The known lamp may have an outer envelope around the lamp vessel, connected thereto with narrowed portions, for example, to the neck-shaped portions of this vessel.

The lamp has a lamp cap of insulating material which comprises electric contacts connected to respective current supply conductors, and in which a fixation member is secured. A metal sleeve grips around the outer envelope. The fixation member is welded to the sleeve after the electric element has been brought into a defined position relative to reference points of the lamp cap through shifting, rotating, and/or pivoting of the lamp vessel.

A metal sleeve around the envelope in the cited patent document forms an alternative for the construction in which the sleeve directly grips the relevant neck-shaped portion. This construction may be used in a lamp having an outer envelope, such as also known from, for example, EP-A 0 570 068 (to which U.S. Pat. No. 5,461,277 corresponds), EP-A 0 581 354 (PHN 14.128), and EP-A 0 579 326 (U.S. Pat. No. 5,412,275), as well as in a lamp without outer envelope. The latter type of lamp is also known from, for example, U.S. Pat. No. 5,216,319), U.S. Pat. No. 5,378,958, and EP-A 0 579 313 (U.S. Pat. No. 5,527,199).

In the lamp of the kind mentioned in the opening paragraph according to Patent Application EP 94 201 416.8 (U.S. Pat. No. 5,677,589), a pinch is provided in the outer envelope adjoining the narrowed portion therein, on which pinch a clamping member bears by which the lamp cap holds the lamp vessel.

The Patent Application EP 94 20 13 18.6 (U.S. Pat. No. 5,646,471) describes a lamp of the kind mentioned in the opening paragraph in which a coating is provided on the outer envelope with which the occurrence of parasitic light in a beam formed by a reflector can be counteracted. A coating having favorable properties for that purpose as regards durability and high light absorption is described in the Patent Application EP 94 20 32 76.4 (PHN 15.094) of earlier date.

The Patent Application EP 94 20 37 50.8 (U.S. Pat. No. 5,619,102) describes a lamp of the kind mentioned in the opening paragraph in which a clamping member is provided around the outer envelope, narrowing towards the relevant neck-shaped portion, while a fixation member of the lamp cap grips the clamping member at its narrow portion.

The Patent Application EP 94 20 35 54.4 (U.S. Pat. No. 5,541,471) describes a lamp of the kind mentioned in the opening paragraph where the outer envelope is formed from UV-absorbing quartz glass doped with cerium, titanium, europium, and aluminium.

A discharge lamp of the kind mentioned in the opening paragraph is also known from U.S. Pat. No. 5,109,181 and EP-A 0 576 071 (U.S. Pat. No. 5,497,049). The lamp has a mercury pressure of approximately 200 bar during operation and accordingly emits light having a continuous spectrum. Lamp power has values of up to 150 W and electrode spacing is approximately 1 to 2 mm. The lamp vessel has a small internal diameter of up to approximately 5 mm and a small internal length of up to approximately 8 mm. The lamp cap of the lamp may be made of insulating material and have a contact for each current supply conductor. Alternatively, the lamp may be permanently accommodated in a reflector such as known, for example, from EP-A 0 595 412 (U.S. Pat. No. 5,506,464) or as described in Patent Application EP 94 20 09 60.6 (U.S. Pat. No. 5,568,967) may be used, for example, for projection purposes. The lamp may in that case have a lamp cap of insulating material or of metal which supports a contact to which a current supply conductor of the lamp is connected. The other current supply conductor may be connected to a contact supported by the reflector.

Because of the comparatively small dimensions of the lamp vessel, it can scarcely be avoided that a location of the lamp vessel where an exhaust tube was tipped is in the path of the radiated light, causing deflection of that light, which may be detrimental in the application of the lamp. In addition, solid or liquid ingredients of the lamp vessel filling may condense in that location, whereby they would be removed from the discharge. It is accordingly desirable to provide the filling ingredients in the lamp vessel before the second seal is made, so that a separate exhaust tube and its fused tip are avoided.

The comparatively small dimensions of the lamp vessel also render it necessary for the lamp vessel to be freed of impurities before it is sealed. The impurities could reduce lamp life or be deposited in the light path on the lamp vessel and cause stray light then.

Quartz glass, i.e. glass having a $SiO_2$ content of at least 98% by weight within the scope of the invention, has a very low linear coefficient of thermal expansion of approximately $10*10^{-7}$. Metals which can be used as current supply conductors under the high thermal loads to which they are exposed in electric lamps have much higher coefficients, for example W approximately $45*10^{-7}$ and Mo approximately $54*10^{-7}$. This means that a wire made from one of these metals embedded in quartz glass at the melting or softening temperature of quartz glass will contract more strongly upon cooling down than does the surrounding glass. The wire then will detach itself from the inside of the glass. The glass will not close around the wire in a vacuumtight manner.

Nevertheless, vacuumtight seals of quartz glass around such metals can be obtained provided the metal has the shape of a foil with sharp edges, also called knife edges or feather edges, because the quartz glass can adapt itself snugly to the shape of the foil, and provided the quartz glass adheres to the foil. To achieve the strength which a current supply conductor must have within and outside the lamp vessel, current supply conductors consisting of a metal foil to which a wire is connected at one end as an internal wire conductor and a wire at the other end as an external current wire, for example by welding, are practically always used in electric lamps having quartz glass lamp vessels. Mo is often used herein as the metal of the foil because this metal has a comparatively high ductility. Current supply conductors often consist of W (internal current wire), Mo (foil), and Mo (external wire).

The expansion of materials implies that no vacuumtight embracing of a current supply conductor by the quartz glass is possible where the conductor is embedded in the quartz glass of a lamp vessel in as far as the internal current wire extends from the cavity of the lamp vessel to on the relevant end portion of the foil, and in as far as the external current wire extends from outside the quartz glass to on the relevant end portion of the foil. The internal and external current conductors have a capillary space around them over these lengths.

In the manufacture of the electric lamp of the kind mentioned in the opening paragraph, the current supply conductors and the electric element are positioned in the lamp vessel under manufacture, and the lamp vessel may be flushed with an inert gas such as, for example, argon, possibly while being heated, so as to drive out impurities. Flushing with inert gas provides a much more effective and fast cleaning than evacuation of the lamp vessel after it has been sealed at one end. Repeated evacuation and flushing with inert gas also has a low effectivity.

Flushing with inert gas, for example in that the second neck-shaped portion is held in a valve from which a flow of inert gas issues, is also useful for preventing oxidation caused by the penetration of air and/or combustion gases from burners when the first neck-shaped portion is locally heated for making a seal therein.

Once the quartz glass has softened sufficiently, it must be pressed against the relevant current supply conductor by means of pinching blocks acting against the pressure of the inert gas which is still flowing, so as to make the first seal. Then the filling is introduced into the lamp vessel and held fixed therein through cooling of the lamp vessel adjacent the first seal, while the free end of the second neck-shaped portion is held by the valve and is kept sealed off from the surroundings. The lamp vessel is then sealed up by locally heating the quartz glass of the second neck-shaped portion and a seal is made over the relevant current supply conductor. Owing to the absence of a gas flow and owing to the comparatively low pressure in the lamp vessel caused by cooling of the lamp vessel, the glass of the second neck-shaped portion, sucked on by the under pressure in the lamp vessel, collapses onto the current supply conductor, thus forming the second seal. The seal may be shaped afterwards, if so desired, with pinching blocks.

It was found that the second seal formed by collapsing and possibly shaped by pinching is more resistant to the changing temperature and pressure conditions of the lamp during and after operation than the first pinched seal.

U.S. Pat. No. 4,389,201 describes the manufacture of a similar electric discharge lamp. The lamp vessel under manufacture is here flushed with argon while the current supply conductors with the electrodes and the solid and liquid ingredients of the filling are being introduced. The free end of the first neck-shaped portion is subsequently heated until the glass has softened to the point where it collapses and closes the relevant portion. The argon flow, however, must be interrupted for this, so that impurities such as air or combustion gases from the burner can penetrate the lamp vessel. When the free end has been closed, argon is admitted into the lamp vessel to a pressure of less than 1 bar, and the two seals are made by causing the glass of the neck-shaped portions to collapse. It is a disadvantage of this method that cleaning of the lamp vessel is interrupted and its effect wiped out in order to close the free end. It is also a disadvantage that an additional operation is to be carried out for closing this free end. A further disadvantage is that ingredients of the lamp filling, for example hygroscopic salts, are in open communication with the surroundings of the lamp during this additional operation and may accordingly themselves absorb impurities.

SUMMARY OF THE INVENTION

It is an object of the invention to provide a capped electric lamp of the kind described in the opening paragraph which is of a reliable and simple construction which is readily realized.

According to the invention, this object is achieved in that a pinch adjoins the first seal and extends over a longitudinal portion of the external current wire.

The first neck-shaped portion is heated for softening the quartz glass when the seal is to be made in the first neck-shaped portion during lamp manufacture. The lamp vessel is flushed with an inert gas such as, for example, argon from a valve through the second neck-shaped portion during this. When the glass has softened to the point where it can be deformed with pinching blocks, a pinch is made on a longitudinal portion of the external current conductor by means of pinching blocks acting against the pressure of the flow of inert gas. The lamp vessel then has a vacuumtight seal in that neck-shaped portion. Heating of the first neck-shaped portion is subsequently continued, while a gas pressure lower than the ambient pressure is provided in the lamp vessel via the second neck-shaped portion. Once the glass has softened sufficiently, the first neck-shaped portion will collapse under the influence of the pressure difference, and the current supply conductor, in particular the metal foil and the adjoining portion of the internal current wire, are embedded in the quartz glass. The quartz glass is at a comparatively high temperature during this, which leads to a good adhesion to the metal foil.

The invention is based inter alia on the recognition that the pinch, which cannot provide a vacuumtight seal of the glass around the metal, can nevertheless serve as a temporary vacuumtight seal of the first neck-shaped portion as long as the quartz glass is kept at its high temperature accompanying the making of the pinch.

It is counteracted that gas is trapped in the seal during collapsing of the glass in that the glass closest to the pinch collapses first owing to its smaller distance to the centre of the first neck-shaped portion as a result of the presence of the pinch, and the gas is driven towards the cavity of the lamp vessel. The seal may subsequently be shaped with pinching blocks.

Shaping is useful for giving the seal a defined shape. It was also found that the quality of a seal is highest when the seal has been shaped. The seal then has a higher pressure resistance.

When the seal has cooled down, the pinch will have lost its vacuumtightness over the external current wire in the first neck-shaped portion owing to the stronger contraction of the external current wire. Lamp manufacture may be completed in conventional manner in that the lamp vessel is provided with its filling and is sealed off in its second neck-shaped portion. During manufacture, the interior of the lamp vessel has been continuously protected from impurities from the surroundings: first by the flow of inert gas, then by the initially vacuumtight pinch, and finally by the vacuumtight seal.

The electric lamp is of a simple, effective and reliable construction. This construction can also be realized in a simple manner. Little more need be done for realizing it than for realizing the known lamp. The additional activity, furthermore, i.e. making of the pinch, need not be done at a different moment in the manufacturing process or in a different location of the lamp vessel compared with the corresponding moment when and location where the seal used to be made in the first neck-shaped portion.

The pinch in the first neck-shaped portion can be clearly distinguished from the seal. The seal was created by collapsing of the glass and accordingly has curved shapes transverse to the longitudinal direction of the current supply conductor, having an oval diameter at the area of the metal foil owing to this foil being much wider than it is thick, obviously, for example, 1.5 mm wide and, for example, 15 to 20 $\mu$m thick. The pinch has an exterior with flat, possibly profiled surfaces which are directed transverse to one another two-by-two, so that the cross-sections of the pinch have basic shapes which are rectangles, parallelograms, or trapeziums. Even if the seal was shaped by means of pinching blocks, possibly profiled pinching blocks, for example having a recess in the location where they will be in opposition to the internal current wire, the adjoining pinch will still be recognizable as such in the finished lamp. The pinch has been entirely shaped by the pinching blocks, starting from a rotationally symmetrical glass tube. The shaped seal which was pinched as an aftertreatment arose from shaping of an elongate, smooth, oval glass mass filled with metal which was given at least substantially flat surfaces. Shaping accordingly leads to entirely different glass displacements than does pinching. Discontinuities in the shapes of the pinched and shaped glass have arisen therefrom, which mark the transition from seal to pinch. These discontinuities are clearly visible with the naked eye or with a magnifier with a factor of, for example, 6×, because quartz glass is particularly transparent and the pinch and seal have mirroring surfaces which are, for example, approximately 3 and approximately 4 mm wide.

The robustness of the manufacturing process may benefit from the pinch extending over the metal foil to beyond the external current wire by a few millimeters, for example 1 to 2 mm. The process is then less sensitive to any inadvertent intermediate cooling-down between making of the pinch and heating of the first neck-shaped portion with the purpose of having the glass collapse.

It is nevertheless advantageous, on the other hand, when the pinch does not extend over the metal foil beyond the end of the external current wire. The pinch then extends entirely over a longitudinal portion of the external current wire. This embodiment has the advantage that the favorable collapsed seal has been created over the entire length between the ends of the internal and external current wires over which the seal between quartz glass and metal foil is vacuumtight.

More in particular, it is advantageous when the pinch extends exclusively over the external current wire. An overlap of the current wire with the metal foil, in the case in which these were created from two separate parts and are not integral as when the foil was made from the wire by processing part thereof, is then accordingly not surrounded by the pinch. This embodiment has the advantage that a good adhesion will obtain over the entire surface area of the metal foil by which the quartz glass in the finished lamp is in contact with this foil.

In this latter modification, again, the seal and the pinch together need not enclose the current supply conductor over a greater length than is the case in the lamp known from the opening paragraph.

It is favorable when the metal foil is made from molybdenum because of the ductility of that metal, so that it is easily handled also as a foil during lamp manufacture. It is equally favorable when the foil comprises an additive chosen from the oxides of yttrium, lanthanum, lanthanides, scandium, magnesium, calcium, strontium, barium, zirconium, hafnium, titanium, tantalum, niobium, thorium, chromium, aluminum, and boron. Such an addition of a comparatively small quantity of, for example, 0.5 to 2, for example approximately 0.75 to 1% by weight distributed through the molybdenum provides an improved adhesion between the quartz glass and the molybdenum.

The electric element may be an incandescent body, in which case the lamp filling may comprise a halogen. Alternatively, however, the element may be a pair of electrodes, in which case the lamp has an ionizable filling, for example a filling of a rare gas such as, for example, xenon, for example at a pressure of several, for example 7 bar in the non-operative condition, and one or several metal halides, possibly with mercury.

The lamp vessel may be enclosed in a reflector, possibly permanently, the latter being closed off with a plate or lens. The reflector may have a contact connected to a current supply conductor at a distance from the lamp cap. The lamp vessel may be coated with an interference filter.

The lamp vessel may have an outer envelope, for example made of quartz glass, which may be connected to the lamp vessel, for example to the neck-shaped portions thereof, for example by means of a fused seal therewith. The envelope may be, for example, UV-absorbing.

The lamp cap may be made of insulating material and have contacts by which it is connected to respective current supply conductors. The contact may lie at the outside of the lamp cap so as to make connection with a connector or lampholder. Alternatively, they may lie inside the lamp cap and be connected to a cable which issues from the lamp cap to the exterior.

DETAILED DESCRIPTION OF PREFERRED EMBODIMENTS OF THE INVENTION

Figure 1A:
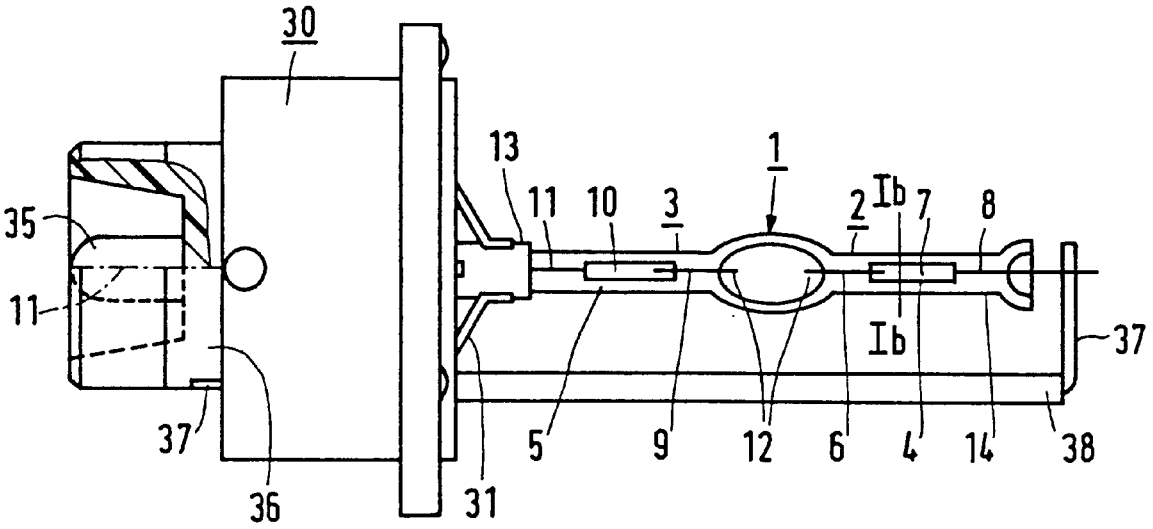
FIG. 1*a* shows the lamp in side elevation.

The capped electric lamp of FIG. 1*a* has a quartz glass lamp vessel 1, made of fused $SiO_2$ in the Figure, which is sealed in a vacuumtight manner and which has in mutual opposition a first 2 and a second neck-shaped portion 3 with respective seals 4, 5 through which respective current supply conductors 6, 7, 8; 9, 10, 11 are passed to an electric element 12 positioned in the lamp vessel. The electric element in the Figure is a pair of electrodes. The lamp vessel has an ionizable filling, for example of xenon, mercury, and metal halides. The lamp has a lamp cap 30 to which the lamp vessel 1 is connected. In the Figure, the second neck-shaped portion 3 is fixed therein. The current supply conductors 6, 7, 8; 9, 10, 11 each have a metal foil 7, 10 which is embedded in its respective seal 4, 5 in a vacuumtight manner and to which a respective internal current wire 6, 9 connected to the electric element is connected at a first end portion, and a respective external current wire 8, 11 issuing from the relevant seal 4, 5 to the exterior is connected at a second end portion.

A pinch 14 extending over a longitudinal portion of the external current wire 8 adjoins the first seal 4.

Figure 3:
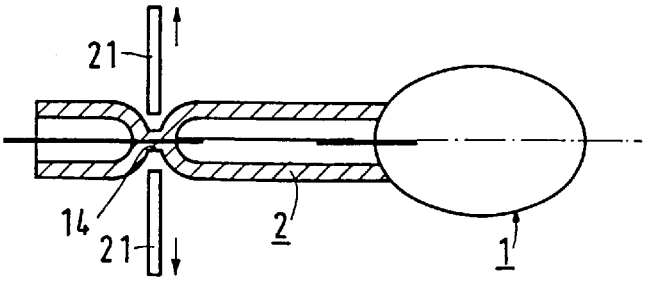

The pinch 14, see FIG. 3, extends in its entirety over a longitudinal portion of the external current wire 8. The glass is yet to be brought into contact with the current supply conductor 6, 7, 8 in the location where exclusively the foil 7 is present in the first neck-shaped portion 2.

The pinch 14 even extends exclusively over the external current wire 8. The foil 7 just fails to be present in the pinch 14.

Figure 1B:
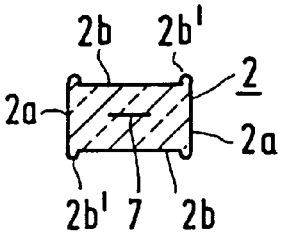
FIG. 1*b* shows the surface of the cross-section Ib—Ib in FIG. 1 taken through the seal in the first neck-shaped portion.
Figure 2:
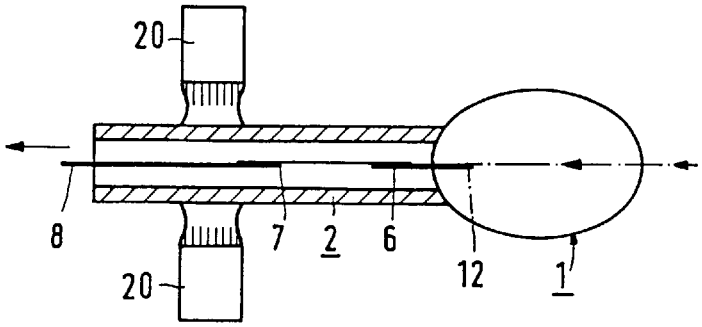
FIGS. 2 to 6 show stages in the manufacture of the seal in the first neck-shaped portion of the lamp of FIG. 1.

The seal 4 in the first neck-shaped portion 2 is shaped with pinching blocks and has substantially flat surfaces 2*a* (FIG. 1*b*). The seal is substantially rectangular in cross-section. It also has substantially flat surfaces 2*b*. The pinching blocks used had recesses for accommodating variations in the size of the pinched glass mass. Raised edges 2*b*' were created in these recesses. Discontinuities are present especially in the raised edges, marking the transition from the pinch to the shaped seal. The flat surfaces 2*b* may have elevated portions at the areas of the internal and or external current wires. These elevations arise owing to a recess in the relevant pinching block so as to provide space in the seal for the wires because the latter are more voluminous than the metal foil.

The metal foils 7, 10 are made of molybdenum and comprise an oxide chosen from the oxides of yttrium, lanthanum, lanthanides, scandium, magnesium, calcium, strontium, barium, zirconium, hafnium, titanium, tantalum, niobium, thorium, chromium, aluminium and boron, in this case approximately 0.75% yttrium oxide by weight dispersed therein.

The lamp vessel 1 (see FIG. 1) internally has a comparable shape where the internal current wires are passed through the quartz glass, for both current wires, the glass approaching the current wires at a comparatively great angle. This results from the fact that the two seals were created through collapsing of the quartz glass, not by pinching. In a pinched seal, the quartz glass will approach the wire at a comparatively small, acute angle, forming a narrowing cavity.

The lamp of FIG. 1 has a lamp cap 30 of insulating material, shown partly broken away, with a central pin contact 35 to which the external current wire 11 is connected. Concentrically therewith, the lamp cap has a cylindrical ring 36 as its second contact, to which a return conductor 37, fastened to the first external current wire 8 and surrounded by an insulator 36, is connected. The lamp vessel 1 has a clamping member 13 around the second neck-shaped portion 3, to which member a fixation member 31 fixed in the lamp cap 30 is welded. The lamp shown may be used as a vehicle headlamp.

In FIGS. 2 to 6, the first neck-shaped portion 2 under manufacture of the lamp vessel 1 of the lamp of FIG. 1 is shown on an enlarged scale. It is locally heated with burners 20 (FIG. 2), while being flushed with inert gas through the second neck-shaped portion 3 under manufacture (not shown).

In FIG. 3, the pinch 14 has just been made with pinching blocks 21. Flushing with inert gas has continued until the moment the pinch was created.

Figure 4:
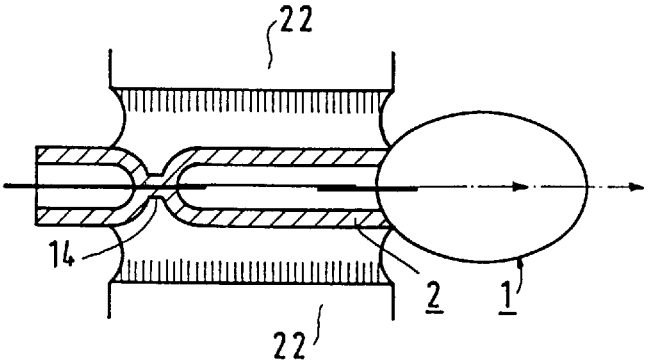

In FIG. 4, the neck-shaped portion 2 under manufacture is heated with burners 22 while the inert gas is exhausted from the lamp vessel through the second neck-shaped portion under manufacture.

Figure 5:
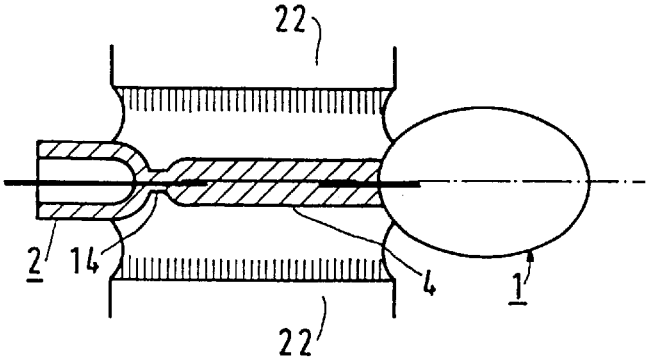

The higher ambient pressure and the high temperature of the quartz glass have caused the quartz glass to collapse in FIG. 5, whereby the permanent seal 4 has been created.

Figure 6:
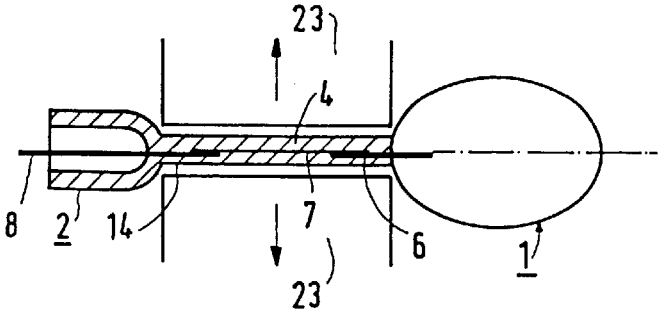

This seal 4 has just been shaped with pinching blocks 23 in FIG. 6. Upon the subsequent cooling-down of the first neck-shaped portion 2, the pinch 14 will now lose its vacuumtightness, but the vacuumtightness of the seal 4 between the internal 6 and the external current wire 8 remains intact.

We claim:

1. Method of making a capped electric lamp of the type comprising a quartz glass vessel which is closed in a vacuum tight manner, first and second neck-shaped portions on opposite sides of said vessel, and first and second current supply conductors extending through the neck-shaped portions to an electric element arranged in the vessel, each of said current supply conductors comprising a metal foil, an internal current wire connecting the metal foil to the electric element, and an external current wire extending from the metal foil to outside the lamp, said method comprising providing a quartz glass vessel having mutually opposed first and second neck-shaped portions in the form of open tubes, a first current supply conductor passing through said first neck-shaped portion, said first current supply conductor comprising a metal foil, an internal current wire connecting the metal foil to inside the vessel, and an external current wire connecting the metal foil to the outside the vessel, locally heating the first neck-shaped portion over said external current wire of said first current conductor while flushing the vessel with inert gas, pinching the first neck-shaped portion over said external current wire of said first current supply conductor, thereby forming a pinch on said external current wire, collapsing said first neck-shaped portion between said pinch and said vessel by means of reduced pressure inside said vessel relative to outside said vessel while locally heating said first neck-shaped portion, thereby forming a first seal on said metal foil, and forming a second seal on the metal foil of a second current supply conductor in said second neck-shaped portion while locally heating said second neck-shaped portion, thereby forming an electric element in said vessel between said internal current wires of said first and second current supply conductors.

2. Method of making a capped electric lamp as in claim 1 wherein, subsequent to collapsing said first neck-shaped portion, said first seal is shaped to produce substantially flat external surfaces.

3. Method of making a capped electric lamp as in claim 1 wherein said pinch extends in its entirety over a portion of said external current wire.

4. Method of making a capped electric lamp as in claim 1 wherein said pinch extends exclusively over the external current wire.

5. Method of making a capped electric lamp as in claim 1 wherein said second seal is formed on the second current supply conductor by locally heating the second neck-shaped portion over said second current supply conductor, and collapsing said second neck-shaped portion over said second metal foil by means of reduced pressure inside said vessel relative to outside said vessel while locally heating said second neck-shaped portion, thereby forming a seal on said second metal foil.

6. A capped electric lamp comprising a quartz glass lamp vessel, which is closed in a vacuum tight manner first and second current supply conductors extending through the neck shaped portions, each of said current supply conductors comprising a metal foil, an internal current wire connecting the metal foil to the electrical element, and an external current wire extending from the metal foil to outside the lamp, wherein seals are formed over both metal foils by collapsing of the quartz glass.

7. A capped electric lamp as in claim 6, said lamp being made by the steps of providing a quartz glass vessel having mutually opposed first and second neck-shaped portions in the form of open tubes, a first current supply conductor passing through said first neck-shaped portion, said first current supply conductor comprising a metal foil, an internal current wire connecting the metal foil to inside the vessel, and an external current wire connecting the metal foil to the outside the vessel, locally heating the first neck-shaped portion over said external portion of said first current conductor while flushing the vessel with inert gas, pinching the first neck-shaped portion over said external current wire of said first current supply conductor, thereby forming a pinch on said external current wire, collapsing said first neck-shaped portion between said pinch and said vessel by means of reduced pressure inside said vessel relative to outside said vessel while locally heating said first neck-shaped portion, thereby forming a first seal on said metal foil, and locally heating the second neck-shaped portion over said second current supply conductor, and collapsing said second neck-shaped portion over said second metal foil by means of reduced pressure inside said vessel relative to outside said vessel while locally heating said second neck-shaped portion, thereby forming a seal on said second metal foil.

* * * * *